United States Patent [19]

Bhagat

[11] Patent Number: 5,077,583

[45] Date of Patent: Dec. 31, 1991

[54] CLOSED LOOP MAGNETIC BRUSH DEVELOPMENT SYSTEM

[75] Inventor: Gopal C. Bhagat, Houston, Tex.

[73] Assignee: Compaq Computer Corporation, Houston, Tex.

[21] Appl. No.: 626,971

[22] Filed: Dec. 19, 1990

[51] Int. Cl.[5] ..... G03G 15/09

[52] U.S. Cl. ..... 355/251; 355/245; 118/657

[58] Field of Search ..... 118/656, 657; 355/245, 355/251, 260

[56] References Cited

U.S. PATENT DOCUMENTS

| | | | |
|---|---|---|---|
| 3,947,107 | 3/1976 | Smith | 355/245 |
| 4,583,842 | 4/1986 | Shimono et al. | 355/260 |
| 4,731,632 | 3/1988 | Fukushima et al. | 355/251 |
| 4,872,036 | 10/1989 | Homma | 355/245 X |

*Primary Examiner*—A. T. Grimley
*Assistant Examiner*—P. Stanzione
*Attorney, Agent, or Firm*—Johnson and Gibbs

[57] ABSTRACT

A printing machine, such as a copier or a printer, is provided with an electrophotographic engine cartridge including a toner cartridge, a rotatable photoconductor drum, and a specially designed magnetic brush development module. The development module utilizes a rotating magnetic roller, disposed in a developer sump, to transport a toner carrier developer material toward a side surface portion of the rotating drum onto which the toner portion of the transported developer is electrically transferred. The development module is operated in a unique closed loop fashion by the action of a specially designed blade member which strips away the toner-depleted developer from the roller and causes it to enter a recycling well. The depleted developer is transferred from the recycling well into the developer sump wherein it is mixed with toner entering the sump from the toner cartridge, and then re-applied, in the form of reconstituted developer, to the magnetic roller for subsequent toner transfer to the rotating drum.

14 Claims, 1 Drawing Sheet

CLOSED LOOP MAGNETIC BRUSH DEVELOPMENT SYSTEM

BACKGROUND OF THE INVENTION

1. Field of the Invention

The present invention relates generally to printing and copying devices, and more particularly relates to electrophotographic printers and copiers utilizing magnetic brush structures to handle a developer material and deposit toner therefrom onto an organic or inorganic photoconductor drum.

2. Description of Related Art

For many years xerographic development processes were utilized in printers and copiers for the development of latent images borne on a photoconductive media. In modern electrophotographic copiers and printers, however, the conventional cascade xerographic process is seldom used, primarily due to the undesirably large size of its necessary components and its relatively low process speed. Instead, a development process commonly referred to as "magnetic brush" development is now widely used in place of the cascade xerographic development process.

In a conventional magnetic brush developer system utilized in an electrophotographic printer or copier, a magnetic roller is rotated within a sump structure in which a predetermined quantity of dry developer mix is disposed, the developer mix consisting of a magnetically attractable carrier material and a dry toner material removably adhered thereto. The rotating magnetic roller attracts a quantity of the developer and magnetically adheres it to its outer side surface, with the carrier portion of the attracted developer quantity being externally coated with toner and projecting radially outwardly from the rotating roller in bristle-like fashion, thus giving the side surface of the roller the appearance of a "brush".

The magnetically adhered quantity of developer is then rotated past a metering blade which "trims" the radially projecting developer material bristles to a predetermined, generally uniform length. The trimmed developer material rotationally exiting the metering blade is then rotated into close adjacency with a side surface portion of a rotating organic photoconductor drum. Previous to being brought into adjacency with the trimmed developer material on the magnetic roller, negatively charged "background" areas, and discharged "image" areas (corresponding to the printed indicia to be transferred to paper stock operatively fed through the printer or copier), are formed on the side surface portion of the rotating drum.

Toner from the trimmed developer layer is electrically stripped from its carrier material and forced onto the previously discharged image areas of the drum side surface portion. The toner-covered discharged areas on the drum are then rotated into adjacency with the paper stock being fed through the machine, and the toner from the discharged drum areas is electrically drawn onto the paper stock and thermally cured thereon.

The drum side surface portion from which toner has been transferred to the moving paper stock is then sequentially rotated past a scraper blade which removes residual toner from the drum portion, a discharge lamp device which removes residual electrical charge from the drum portion, a charging device (such as a scorotron) which negatively charges the drum portion, and a discharge device (such as a digitally controlled laser beam) which forms the electrically discharged image areas on the otherwise negatively charged drum portion. The drum side surface portion is then again rotated into adjacency with a trimmed quantity of developer externally carried by the magnetic roller.

After a given portion of the trimmed developer material carried by the rotating magnetic roller has transferred its toner constituent to the rotating drum, the now toner-depleted developer portion remains magnetically adhered to the roller and is rotated back into the developer sump at which time additional non-depleted developer material (i.e., developer containing both toner and carrier material) is magnetically adhered to the depleted developer layer and passed across the previously mentioned metering blade on its way to the side surface of the rotating drum. This conventional developer transfer scheme, used in conjunction with magnetic brush development, is commonly referred to as an "open loop" developer transfer path.

While the use of this open loop developer routing is widely accepted and practiced in the printer/copier art, it is subject to a variety of well known problems, limitations and disadvantages. For example, conventional open-looped magnetic brush development modules used in electrophotographic machines, such as printers and copiers, are quite susceptible to print quality degradation and variation over the operating life of the module. This is due in large part to the unavoidable progressive build-up of depleted developer material on the magnetic roller. As this depleted layer progressively thickens, the ratio of toner to carrier material in the overall developer layer approaching the metering blade also progressively diminishes.

Related to this problem are the problems of image density depletions and surges, and the difficulty of sufficiently meeting instantaneous demands for additional toner such as when graphics or other large image areas are to be printed. Additionally, the conventional open loop method of magnetic brush development tends to undesirably shorten the effective operating life of a given quantity of carrier material and the OPC drum.

It can readily be seen from the foregoing that it would be highly desirable to provide improved magnetic brush development apparatus and methods which would eliminate or at least significantly reduce the aforementioned problems, limitations and disadvantages typically associated with conventional magnetic brush development apparatus and methods of the general type described above. It is accordingly an object of the present invention to provide such improved apparatus and methods.

SUMMARY OF THE INVENTION

In carrying out principles of the present invention, in accordance with a preferred embodiment thereof, an electrophotographic printing machine, such as a copier or printer, is provided with a specially designed electrophotographic engine cartridge which includes a rotationally drivable, electrically chargeable organic photoconductor drum, a magnetic brush development module, and a toner cartridge structure operatively connected to the development module. The various electrical functions of the cartridge, the various necessary movements of its mechanical components, and the movement of an imprintable medium, such as paper stock, through the machine, are effected and appropriately regulated by generally conventional drive and control means. As used herein, the term "printing machine" (or "apparatus") is intended to encompass any type of image reproduction machine (including printers and copiers) which utilizes the transfer of a toner portion of a developer material to an electrically charged toner transfer member, such as a latent image bearing organic photoconductor drum (OPC), in its overall reproduction process.

In a preferred embodiment thereof, the previously mentioned development module includes a rotationally driven magnetic roller disposed in a developer sump adapted to hold a quantity of developer material having a ferrite or other magnetically comparable carrier constituent and a toner constituent. During operation of the development module, and rotation of the OPC, the roller operates to magnetically adhere a quantity of developer to its outer side surface and then rotationally transport the adhered developer into adjacency with a side surface portion of the rotating drum which electrically draws the toner constituent from the passing developer portion and deposits it onto "image" areas of the drum surface for subsequent transfer to paper stock, or other imprintable medium, being operatively fed through the machine.

The now toner-depleted developer portion still adhered to the magnetic roller is rotated generally back toward the developer sump. However, in sharp contrast to the open-looped operation of conventional magnetic brush-type development apparatus, the toner-depleted developer is not permitted to simply remain on the roller for subsequent application thereon of non-depleted developer material.

Instead, according to an important aspect of the present invention, the development module is operated in a unique "closed loop" fashion which advantageously precludes the undesirable build-up of toner-depleted developer on the magnetic roller typically associated with the conventional open loop operation of magnetic brush development modules. The closed loop method of magnetic brush development control provided by the present invention basically comprises the steps of stripping away the toner-depleted developer from the magnetic roller prior to the rotation of the depleted developer into the developer sump; transferring the stripped-away, depleted developer into the sump; transferring toner from the toner cartridge into the developer sump; mixing the transferred toner and depleted developer within the sump to form reconstituted developer; and permitting an essentially developerless side surface portion of the rotating roller, entering the sump, to magnetically adhere thereto a quantity of reconstituted developer for subsequent rotational delivery thereof to the rotating OPC.

In an illustrated embodiment of the closed loop development module of the present invention, the structure utilized to carry out the aforementioned method preferably comprises a horizontally sloped recycling well structure which underlies the magnetic roller and its associated developer sump. During rotation of the magnetic roller, first stripper blade means strip away the depleted developer from the roller and directs the detached developer into the upper end of the well, whereupon the developer travels by gravity into the lower end of the well.

Next, a rotating magnetic recycle roller disposed in the lower end of the well picks up the depleted developer and rotationally delivers it into engagement with a second blade structure that strips the depleted developer from the recycle roller. This stripped off developer is then forced into the developer sump, via a suitable wall opening therein, at a location adjacent an inflow of toner from the toner cartridge. Mixer means, disposed within the developer sump, then operate to mix toner and depleted developer (i.e., the carrier developer constituent) entering the sump to form therefrom the reconstituted developer and deliver the same to an essentially developerless side portion of the magnetic roller being rotated through the sump.

In a preferred embodiment thereof, the first stripper blade means comprise an elongated blade structure carried by the bottom wall of the recycling well and operatively contacting a lower side portion of the magnetic roller. A longitudinally spaced series of slots are formed laterally through the elongated blade structure and are operative to permit toner-depleted developer stripped away by the blade structure to pass therethrough and into the well for gravity delivery to the aforementioned recycle roller at the bottom end of the well.

According to another aspect of the present invention, the previously mentioned mixer means preferably comprise a rotatable shaft extending through the developer sump, the shaft being parallel to and laterally spaced apart from the magnetic roller. Secured to the shaft in a longitudinally spaced apart orientation thereon are a plurality of parallel elliptical disc members whose axes are canted relative to the shaft axis. Adjacent pairs of discs longitudinally overlap one another, and the discs are provided with transversely projecting peripheral lips around their outer circumferences.

During operation of the mixer means, the shaft is rotated in a direction opposite to the rotational direction of the magnetic roller. The rotating discs operate to mix toner and stripped away, depleted developer entering the sump, to form reconstituted developer. The rotating discs also function to lift the reconstituted developer over the edge of a mixing dam member, whereupon the reconstituted developer falls to the bottom of the sump for pick-up by a previously stripped side surface portion of the rotating magnetic roller. The lifting action of the rotating discs is enhanced by the previously mentioned peripheral lips thereon.

Compared to conventional open loop operation of magnetic brush-based developement apparatus, the closed loop operation of the present invention provides a variety of desirable advantages including the provision of enhanced, more consistent and uniform printed image quality; the damping and stabilization of image density depletions and surges; and an improved ability to meet instantaneous demands for additional toner typically arising when graphics or other large image areas are to be printed or copied. Additionally, the effective operating life of the development module is beneficially increased.

Moreover, the closed loop magnetic brush development module of the present invention may be easily and relatively inexpensively incorporated into a wide variety of electrophotographic printing machines, and may be constructed using only a small number of simple and relatively inexpensive components. Additionally, principles of the present invention may be applied to other types of image reproduction machines in which a toner portion of a toner/carrier developer material is deposited on a toner transfer member, from a developer carrier roller, for subsequent deposition onto an imprintable medium such as paper stock.

DETAILED DESCRIPTION

Figure 1:
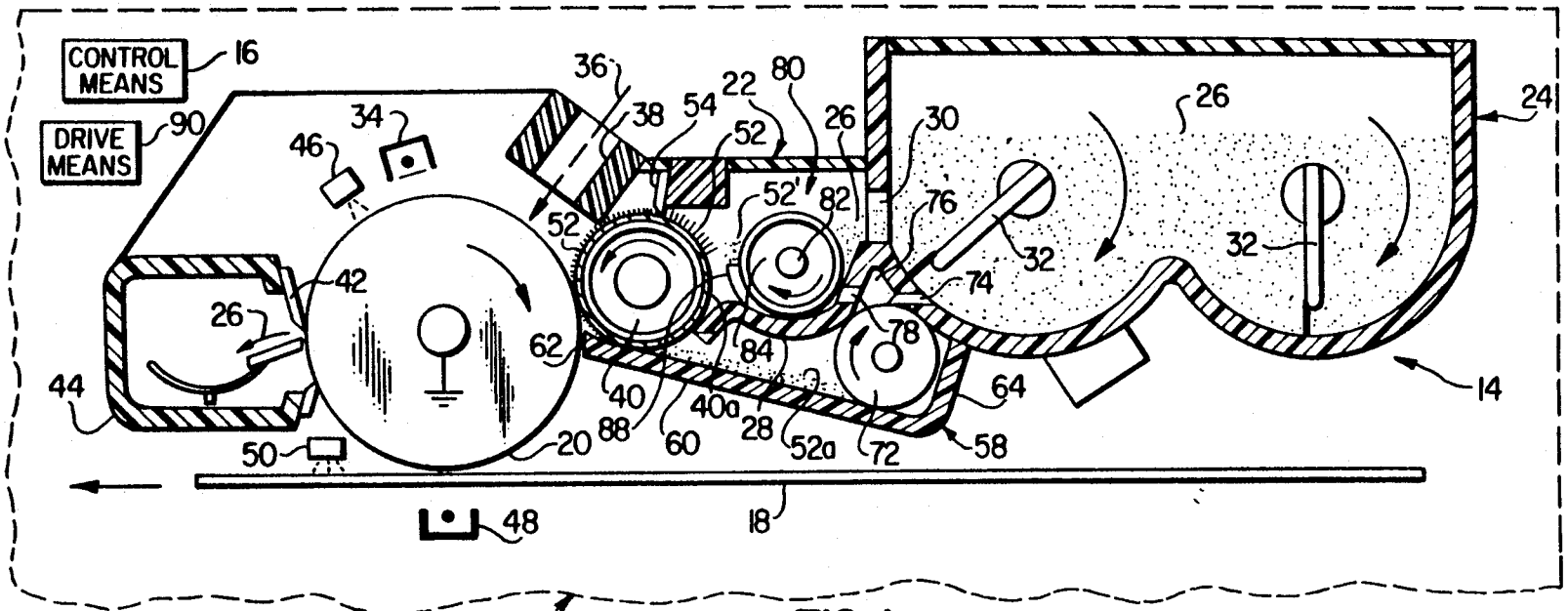
FIG. 1 is a simplified schematic cross-sectional view through a portion of a representative electrophotographic printing machine, illustratively a laser printer, having operatively disposed therein an electrophotographic engine cartridge which embodies principles of the present invention and includes a specially designed closed loop magnetic brush development module.

Schematically depicted in FIG. 1 is a portion of a representative printing machine, illustratively in the form of a laser printer 10, having a housing 12 within which is operatively disposed a specially designed electrophotographic engine cartridge 14 embodying principles of the present invention. Engine cartridge 14 is operatively drivable, in response to the operation of generally conventional control means 16 which effectuate and regulate the operation of the cartridge's mechanical and electrical components, to imprint predetermined images on an imprintable medium, such as paper stock 18, conventionally driven leftwardly through the housing 12 beneath the engine cartridge 14.

As schematically illustrated, the engine cartridge 14 includes, adjacent its left end, a conventional organic photoconductor drum (OPC) 20, a uniquely operative closed loop magnetic brush development module 22 positioned rightwardly adjacent OPC 20, and a generally conventional toner cartridge 24 removably secured to a right end portion of the development module 22. Toner cartridge 24 has disposed therein a quantity of dry toner powder material 26 which may be selectively delivered into a developer sump portion 28 of the development module 22, via a wall opening 30 in the toner cartridge, through the rotational operation of conventional toner lifter structures 32 disposed within the toner cartridge 24.

During operation of the engine cartridge 14, the OPC 20 is rotationally driven in a clockwise direction which causes each circumferential outer side surface portion of the rotating drum 20 to be sequentially passed by a scorotron charging unit 34, a digitally controlled laser beam 36 entering the cartridge 14 through an exposure slot 38, a side surface portion of a magnetic roller portion 40 of the development module 22 being rotationally driven in a counterclockwise direction, the leftwardly moving paper stock 18, a scraper blade 42 disposed on a toner collection housing 44, and a discharge lamp 46.

The operation of the rotating drum 20 is conventional, and will now be briefly described. As each circumferential outer side surface portion of the drum 20 passes the charging unit 34, it is negatively charged, and when the drum surface portion passes beneath the incoming laser beam 36, certain portions thereof are caused to be discharged, thereby forming the "image" areas of the drum surface which will later create the darkened image areas on the leftwardly moving paper stock 18. As the drum surface portion is rotated past the counter-rotating magnetic roller 40, toner 26 is electrically transferred onto the discharged image areas of the drum surface which is then rotated to a position above a transfer corotron 48 which electrically attracts the toner from these drum surface image areas onto the upper side surface of the paper stock 18. The toner deposited onto the top side of the moving paper stock 18 is then passed under a conventional thermal fusing device 50 which thermally fuses the transferred toner onto the top side of the paper stock.

The drum surface portion is then further rotated in a clockwise direction into engagement with the scraper blade 42 which operates to strip away residual toner 26 from the drum and cause the stripped away residual toner 26 to fall into the toner collection housing 44. Finally, the representative drum side surface portion is rotated past the discharge lamp 46 which functions to remove the residual electric charge on the drum surface portion before it passes beneath the charging unit 34 and is uniformly re-charged to initiate a subsequent image reproduction cycle.

According to an important aspect of the present invention, the magnetic brush development module 22 is operated in a unique closed loop fashion which will now be described. Disposed within the sump 28 is a quantity of conventional developer material which has a ferrite or other magnetically comparable carrier constituent, and a toner constituent formed by a quantity of toner 26. During counterclockwise rotation of the magnetic roller 40, a quantity of developer is magnetically attracted to the side surface portion of the roller disposed within sump 28, and magnetically adhered to such side surface portion in the form of radially outwardly projecting "bristles" 52, the formation of such bristles 52 on the roller 40 giving rise to its common characterization as a "magnetic brush".

The developer bristles 52 initially deposited on the outer side surface of the roller 40 are passed under a conventional metering blade 54 to trim down the bristles 52, as they rotationally exit the sump 28, to a predetermined, generally uniform "height". The shortened bristles 52 are then rotated into adjacency with an exterior side surface portion of the rotating drum 20, at which point the toner constituent of the developer bristles is withdrawn from the carrier constituent thereof and transferred onto the discharge "image" area of the drum surface for subsequent transfer to the paper stock 18 as previously described.

Just subsequent to this toner transfer to the rotating drum 20, the operation of the magnetic brush development module 22 of the present invention makes a significant departure from the conventional "open loop" operation of previously utilized magnetic brush development devices. Specifically, with reference now to FIGS. 1 and 4, the toner-depleted developer $52_a$ (FIG. 4) remaining on the outer side surface of the magnetic roller 40 after toner transfer to the rotating drum 20 is not rotated back into the interior of the developer sump 28. Instead, essentially all of the toner-depleted developer $52_a$ is stripped away from the outer side surface of the roller 40 by means of a specially designed stripper blade 56 interiorly supported within a recycling well housing 58 which underlies the development module 22. The recycling well housing 58 has a downwardly and rightwardly sloping bottom wall portion 60 which terminates at its left end with a leading edge portion 62 disposed adjacent the drum 20 and generally beneath the roller 40, and terminates at its right end with an upturned rear end wall portion 64 that extends to the bottom side of a left end portion of the toner cartridge 24.

Figure 4:
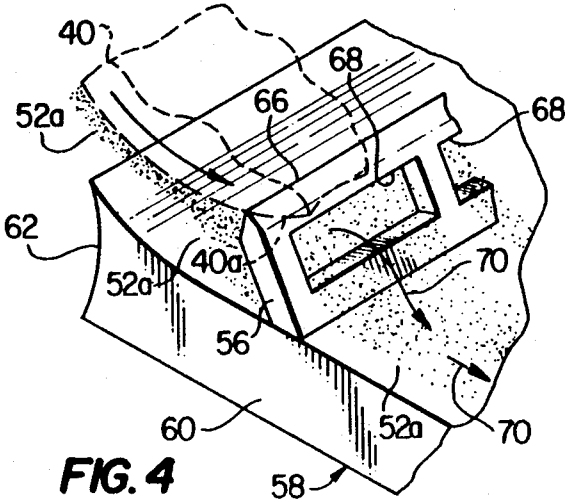
FIG. 4 is an enlarged scale perspective view of a portion of a specially designed stripper blade structure used in conjunction with a magnetic roller portion of the development module.

As best illustrated in FIG. 4, the stripper blade 56 is laterally tilted in a leftward direction, and is provided along its top side edge portion with a sharpened edge 66 which engages the outer side surface of the rotating magnetic roller 40. During the illustrated counterclockwise rotation of the roller 40, the blade edge portion 66 scrapes away the toner-depleted developer $52_a$ causing it to fall onto the top side surface of the bottom well housing wall 60 and creating a now-cleaned side surface portion $40_a$ on the roller 40 positioned to the right of the blade edge 66 as viewed in FIG. 4. This cleaned side edge portion of the roller is subsequently rotated into the developer sump 28.

By means of a longitudinally spaced series of slots 68 formed laterally through the scraper blade 56, the stripped away, depleted developer $52_a$ falling onto the bottom well housing wall 60 to the left of the blade 56 is permitted to pass rightwardly through the blade 56 as indicated by the arrows 70 in FIG. 4. The depleted developer $52_a$ rightwardly traversing the stripper blade 56 travels by gravity downwardly and rightwardly along the sloped bottom well housing wall 60 until it reaches a magnetic recycle roller 72 disposed in the lower right corner of the well housing 58, in a parallel relationship with the magnetic roller 40, and being driven in a clockwise direction as indicated in FIG. 1.

As the toner-depleted developer $52_a$ rightwardly reaches the rotating recycle roller 72, it becomes magnetically adhered to a left side surface portion thereof and is rotated into engagement with a leftwardly projecting stripper blade 74 (FIG. 1), carried by the toner cartridge 24, which strips away the developer $52_a$ and forces it into a generally triangularly cross-sectioned cavity 76 disposed at the juncture between the toner cartridge 24 and the developer sump 28 and communicating with the interior of the sump 28 via a passage 78 formed in the outer wall of the sump.

The depleted developer $52_a$ forced into the cavity 76 is, in turn, forced into the interior of the developer sump 28, via the passage 78, the depleted developer $52_a$ entering the sump 28 being adjacent toner 26 being delivered into the sump 28 through the toner cartridge wall opening 30. Upon their entry into the sump 28, the toner 26 and the depleted developer $52_a$ are drawn into a specially designed mixer structure 80 which will now be described in conjunction with FIGS. 1–3.

Figure 3:
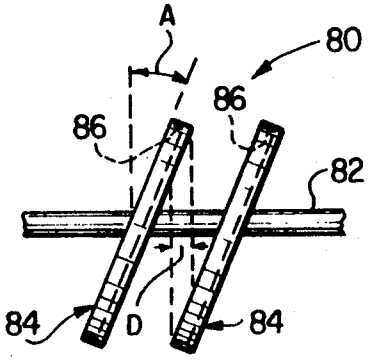
FIG. 3 is a right side elevational view of the mixer structure portion perspectively shown in FIG. 2.

Mixer structure 80 includes an elongated drive shaft 82 which extends through the developer sump 70 in a parallel, rightwardly spaced relationship with the magnetic roller 40. Fixedly secured to the shaft 82 for rotation therewith are a plurality of longitudinally spaced, parallel elliptical disc members 84 (only two of which being illustrated in FIGS. 2 and 3), each of the discs 84 having formed thereon laterally outwardly projecting peripheral lip portions 86 around their outer circumferences. As best illustrated in FIG. 3, the parallel discs 84 are not perpendicular to the shaft 82, but are canted relative to its longitudinal axis by an angle "A". Additionally, as also illustrated in FIG. 3, the longitudinal spacing between each adjacent pair of parallel discs 84 is such that they longitudinally overlap by a small distance "D". As a result, the depleted developer $52_a$ and the toner 26 are mixed longitudinally along shaft 82.

Figure 2:
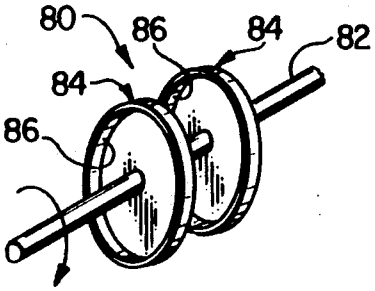
FIG. 2 is a perspective view of a portion of a toner/-carrier mixer structure used in the development module.

Durin the clockwise rotation of the mixer shaft 82, as indicated in FIGS. 1 and 2, the canted discs 84 are also rotated in a clockwise direction. Rotation of the discs 84 draws the depleted developer $52_a$ and the toner 26 entering the sump 28 to the right of the discs into the interior spaces between adjacent pairs of discs. The rotating discs mix the toner and previously depleted developer $52_a$ and form therefrom reconstituted developer 52' which is lifted to the top edge of an adjustable metering shield member 88 extending upwardly from the bottom wall of the sump 28 and positioned between the discs 84 and the magnetic roller 40. The reconstituted developer 52' is caused to spill leftwardly over the top edge of the metering shield 88 and fall toward the bottom of the sump 28 at which point it is magnetically attracted and adhered to the cleaned side surface portion $40_a$ of the roller 40 being rotated through the interior of the sump 28. Accordingly, the developer bristles 52 shown in FIG. 1 within the interior of sump 28 are formed essentially entirely from the reconstituted developer 52'.

The unique closed looped operation of the improved magnetic brush development module 22 just described provides a variety of operating advantages compared to the conventional open loop operation of magnetic brush development structures in which the toner-depleted developer is permitted to remain on the outer side surface of the rotating magnetic roller. For example, such closed loop operation of the development module 22 provides for enhanced, more consistent and uniform image quality on the paper stock 18, desirably dampens and stabilizes image density depletions and surges, and provides better capability for meeting instantaneous demands for additional toner typically arising when graphics or other large area images are to be printed upon the paper being fed through the printing machine.

Additionally, the use of such closed loop operating method in conjunction with the improved development module 22 beneficially prolongs the effective operating life of the module. The improved magnetic brush development module 22 of the present invention may be easily and relatively inexpensively constructed from a small number of relatively simple, yet quite reliable mechanical components. It will be readily appreciated by those skilled in this particular art that the various rotational motions imparted to the mechanical components of the engine cartridge 14 may be effected in a variety of conventional manners which form no part of the present invention. Accordingly, the necessary drive structures required to impart such previously described rotationally motions have simply been schematically depicted in FIG. 1 as drive means 90.

The foregoing detailed description is to be clearly understood as being given by way of illustration and example only, the spirit and scope of the present invention being limited solely by the appended claims.

What is claimed is:

1. For use in conjunction with an electrically charged printing machine drum, magnetic brush development apparatus for delivering toner to said drum, said apparatus comprising:

sump means for receiving, from sources thereof, a toner material and a magnetically attractable carrier material to which said toner material is removably adherable;

mixer means disposed within said sump means and operable to mix toner and carrier material received thereby into a developer material;

magnetic transfer roller means rotatable to sequentially move an outer side surface portion thereof:

(1) into said sump means for magnetic deposition on said outer side surface portion of a quantity of the mixed developer material, and (2) out of said sump means into adjacency with an outer side surface portion of said drum to permit electrical transfer thereto of a toner portion of said quantity of the mixed developer material, thereby converting said quantity of the mixed developer material to a toner-depleted developer material;

stripper means for stripping away said toner-depleted developer material from said magnetic transfer roller means side surface portion in a manner causing it to re-enter said sump means in a cleaned, generally developerless condition; and recycling means for receiving the stripped away, toner-depleted developer material and transferring it into said sump means for receipt by said mixer means and mixture thereby with toner material received by said sump means to form reconstituted developer material positioned to be magnetically attracted and adhered to a magnetic transfer roller means outer side surface portion previously cleaned by said stripper means and internally traversing said sump means, said recycling means including:

well means disposed beneath said sump means and operative to receive toner-depleted developer material stripped away from said magnetic transfer roller means, and transfer means for transferring toner-depleted developer material from within said well means to within said sump means.

2. The magnetic brush development apparatus of claim 1 wherein said mixer means include:

a drive shaft extending through said sump means in a parallel, laterally spaced apart relationship with said magnetic roller means, a series of parallel disc members having central portions circumscribing and anchored to said drive shaft at longitudinally spaced apart locations thereon, each of said disc members having an axis forming an angle with the drive shaft axis, and means for rotating said drive shaft about its axis.

3. The magnetic brush development apparatus of claim 2 wherein:

the disc members in each longitudinally adjacent pair thereof overlap one another.

4. The magnetic brush development apparatus of claim 2 wherein:

each disc member is elliptical and has a transverse lip extending around its circumferential periphery.

5. The magnetic brush development apparatus of claim 1 wherein said transfer means include:

a cavity disposed in an upper portion of said well means, a wall opening formed in said sump means and intercommunicating the interiors of said sump means and said cavity, magnetic recycle roller means disposed within said well means beneath said cavity and being rotatable to transport toner-depleted developer material into said cavity from a bottom portion of said well means, and stripper blade means projecting into said cavity and operative to remove toner-depleted developer material from said magnetic recycle roller means and cause the removed toner-depleted depleted developer material to enter said well means through said cavity and said wall opening.

6. The magnetic brush development apparatus of claim 5 wherein:

said well means have a sloping bottom wall along which toner-depleted developer material entering said well means may move by gravity to said magnetic recycle roller means.

7. The magnetic brush development apparatus of claim 6 wherein said stripper means include:

an elongated stripper blade member disposed within said well means, longitudinally extending parallel to said magnetic transfer roller means, and having a first side edge portion secured to said bottom wall, a second side edge portion operatively engaging said magnetic transfer roller means, and a longitudinally spaced series of openings extending transversely therethrough.

8. The magnetic brush development apparatus of claim 1 further comprising:

toner supply means, operatively supported adjacent said sump means, for supplying toner to said sump means for use therein by said mixer means.

9. For use in a printing machine, such as a printer or copier, through which an imprintable medium is moved, an electrophotographic engine cartridge comprising:

rotationally drivable photoconductor drum means having a side surface portion operatively chargeable, during rotation of said drum means, to electrostatically attract and hold a quantity of toner and rotationally transport the quantity of toner into adjacency with the imprintable medium for transfer thereto;

developer means, supported in operative adjacency with said drum means, for supplying toner to said drum means, said developer means including:

sump means for receiving, from sources thereof, a toner material and a magnetically attractable carrier material to which said toner material is removably adherable, mixer means disposed within said sump means and operable to mix toner and carrier material received thereby into a developer material, magnetic roller means rotatable to sequentially move an outer side surface portion thereof into said sump means for magnetic deposition on said outer side surface portion of a quantity of the mixed developer material, and then out of said sump means to permit electrostatic transfer therefrom of a toner portion of said quantity of the mixed developer material, thereby converting said quantity of the mixed developer material to a toner-depleted developer material, stripper means for stripping away said toner-depleted developer material from said magnetic roller means side surface portion in a manner causing it to re-enter said sump means in a cleaned, generally developerless condition, and recycling means for receiving the stripped away, toner-depleted developer material and transferring it into said sump means for receipt by said mixer means and mixture thereby with toner material received by said sump means to form reconstituted developer material positioned to be magnetically attracted and adhered to a magnetic roller means outer side surface portion previously cleaned by said stripper means and internally traversing said sump means said recycling means including:

well means disposed externally of said sump means and operative to receive toner-depleted developer material stripped away from said magnetic roller means, and transfer means, disposed within said well means, for transferring the toner-depleted developer material from within said well means to within said sump means;

toner cartridge means, supported in operative adjacency with said developer means, for supplying toner material to said sump means.

10. For use in conjunction with an electrically charged printing machine drum, magnetic brush development apparatus for delivering toner to said drum, said apparatus comprising:

sump means for receiving, from sources thereof, a toner material and a magnetically attractable carrier material to which said toner material is removably adherable;

mixer means disposed within said sump means and operable to mix toner and carrier material received thereby into a developer material;

magnetic transfer roller means rotatable to sequentially move an outer side surface portion thereof:

(1) into said sump means for magnetic deposition on said outer side surface portion of a quantity of the mixed developer material, and (2) out of said sump means into adjacency with an outer side surface portion of said drum to permit electrical transfer thereto of a toner portion of said quantity of the mixed developer material, thereby converting said quantity of the mixed developer material to a toner-depleted developer material;

stripper means, disposed externally of said sump means, for stripping away said toner-depleted developer material from said magnetic transfer roller means side surface portion in a manner causing it to re-enter said sump means in a cleaned, generally developerless condition; and recycling means for receiving the stripped away, toner-depleted developer material and transferring it into said sump means for receipt by said mixer means and mixture thereby with toner material received by said sump means to form reconstituted developer material positioned to be magnetically attracted and adhered to a magnetic transfer roller means outer side surface portion previously cleaned by said stripper means and internally traversing said sump means, said recycling means including:

well means, disposed externally of said sump means, for receiving toner-depleted developer material stripped away from said magnetic transfer roller means, and transfer means for transferring toner-depleted developer material from within said well means to within said sump means.

11. A printing machine comprising:

a housing;

means for moving an imprintable medium through said housing;

rotationally drivable photoconductor drum means having a side surface portion operatively chargeable, during rotation of said drum means, to electrostatically attract and hold a quantity of toner and rotationally transport the quantity of toner into adjacency with the imprintable medium for transfer thereto;

means for transferring the quantity of toner from said drum means side surface portion to the imprintable medium;

means for operatively charging said drum means side surface portion;

sump means for receiving, from sources thereof, a toner material and a magnetically attractable carrier material to which said toner material is removably adherable;

mixer means disposed within said sump means and operable to mix toner and carrier material received thereby into a developer material;

rotationally drivable magnetic roller means supported by said sump means and disposed in parallel adjacency with said drum means, said magnetic roller means, during rotation thereof, being operative to magnetically attract and adhere to a side surface portion thereof a quantity of said developer material from within said sump means, and rotationally transport the adhered developer material into a facing relationship with said side surface portion of said drum means for electrical transfer thereto of toner from said quantity of developer material and a resulting conversion of said developer material to a toner-depleted developer material;

means for rotationally driving said magnetic roller means;

developer recycling means for stripping away the toner-depleted developer material from said side surface portion of the rotating magnetic roller means and delivering the stripped away, toner-depleted developer material to the interior of said sump means for mixture therein with said quantity of toner material to form a reconstituted developer material positioned to be magnetically attracted and adhered to a side surface portion of the rotating magnetic roller means in place of toner-depleted developer material previously stripped away therefrom, said developer recycling means including:

a first stripper blade disposed externally of said sump means and operatively engaging said rotating magnetic roller means, well means, disposed externally of said sump means, for receiving toner-depleted developer material removed from said magnetic roller means, and transfer means for transferring toner-depleted developer material from within said well means to within said sump means.

12. The printing machine of claim 11 wherein:

said well means have a cavity therein which communicates with the interior of said sump means adjacent said mixer means and said transfer means include rotationally drivable magnetic recycle roller means disposed within said well means and operable to magnetically attract and rotationally transport into said cavity toner-depleted developer material received by said well means; and second stripper blade means for removing toner-depleted developer material from said magnetic recycle roller means and causing the removed toner-depleted developer material to be deposited within said cavity and forced into said sump means.

13. The printing machine of claim 11 wherein said machine is a printer.

14. The printing machine of claim 13 wherein said machine is a laser printer.

* * * * *